US010031481B2

(12) United States Patent
Jaccard et al.

(10) Patent No.: US 10,031,481 B2
(45) Date of Patent: Jul. 24, 2018

(54) TEMPERATURE DRIVEN WINDING SYSTEM

(71) Applicant: Preciflex SA, Neuchâtel (CH)

(72) Inventors: Alain Jaccard, Ste-Croix (CH); Lucien Vouillamoz, Feusisberg (CH); Yves Ruffieux, St. Aubin/FR (CH); Dominique Renaud, Nyon (CH); Johann Rohner, Yverdon-les-Bains (CH)

(73) Assignee: Preciflex SA, Neuchâtel (CH)

( * ) Notice: Subject to any disclaimer, the term of this patent is extended or adjusted under 35 U.S.C. 154(b) by 0 days.

(21) Appl. No.: 14/776,790

(22) PCT Filed: Mar. 17, 2014

(86) PCT No.: PCT/IB2014/000373
§ 371 (c)(1),
(2) Date: Sep. 15, 2015

(87) PCT Pub. No.: WO2014/140779
PCT Pub. Date: Sep. 18, 2014

(65) Prior Publication Data

US 2016/0033936 A1 Feb. 4, 2016

Related U.S. Application Data

(60) Provisional application No. 61/787,727, filed on Mar. 15, 2013.

(51) Int. Cl.
*G04B 1/14* (2006.01)
*G04B 1/26* (2006.01)
(Continued)

(52) U.S. Cl.
CPC ..... *G04B 5/22* (2013.01); *G04B 1/14* (2013.01); *G04B 1/26* (2013.01); *G04B 5/203* (2013.01)

(58) Field of Classification Search
CPC ... G04B 1/14; G04B 1/26; G04B 5/22; G04B 5/203; F03G 7/06
See application file for complete search history.

(56) References Cited

U.S. PATENT DOCUMENTS 2,749,700 A * 6/1956 Seligman ..... G04B 1/00 368/202
4,067,381 A * 1/1978 Lord ..... F01P 11/18 123/41.15
(Continued)

FOREIGN PATENT DOCUMENTS

CH 238 871 A 8/1945
EP 1 101 937 A1 5/2001
(Continued)

OTHER PUBLICATIONS

International Search Report, International patent aplication No. PCT/IB2015/000446, dated Nov. 13, 2015.

*Primary Examiner* — Vit W Miska
(74) *Attorney, Agent, or Firm* — Da Vinci Partners LLC; John Moetteli

(57) ABSTRACT

A drive system for energizing a device that includes a bellows actuated drive. The bellows actuated drive provides linear forward and backward movement by fluid expansion and contraction of a fluid within a reservoir according to a temperature differential while the reservoir is in fluid contact with the bellows. In one variant, two bellows are configured in a V shaped conformation. Various devices are driven using the drive system of the current invention and include a timepiece, a medical device, an implantable medical device, a cardiac rhythm management device, a hearing aid, a medical micro-injector, a sensor, and a biometric transmitter.

8 Claims, 20 Drawing Sheets

(51) Int. Cl.
*G04B 5/22* (2006.01)
*G04B 5/20* (2006.01)

(56) References Cited

U.S. PATENT DOCUMENTS

| | | | | |
|---|---|---|---|---|
| 6,427,444 | B1 * | 8/2002 | Miyazawa | F03G 7/06 60/508 |
| 6,804,171 | B2 * | 10/2004 | Miyazawa | H02K 7/1853 368/204 |
| 7,245,561 | B2 * | 7/2007 | Coleman | G04B 19/00 368/223 |
| 2009/0219789 | A1 * | 9/2009 | Meadows | G04F 13/06 368/223 |
| 2010/0118661 | A1 * | 5/2010 | Ruchonnet | G04B 1/265 368/65 |
| 2014/0000253 | A1 * | 1/2014 | Perreux | G04B 5/22 60/528 |
| 2014/0328146 | A1 * | 11/2014 | Vouillamoz | F04B 53/14 368/65 |
| 2016/0209810 | A1 * | 7/2016 | Rohner | F15B 1/04 |

FOREIGN PATENT DOCUMENTS

| | | |
|---|---|---|
| FR | 1552838 | 1/1969 |
| GB | 1 035 791 A | 7/1966 |
| JP | S52 157854 U | 11/1977 |
| JP | S58 106185 A | 6/1983 |

* cited by examiner

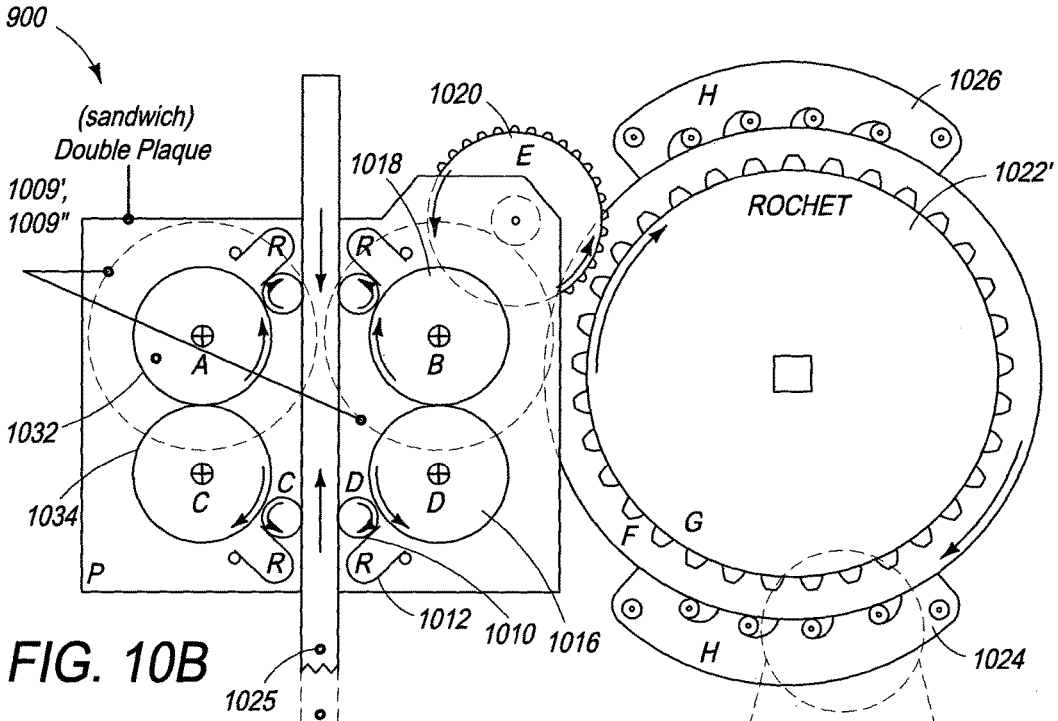
FIG. 10B
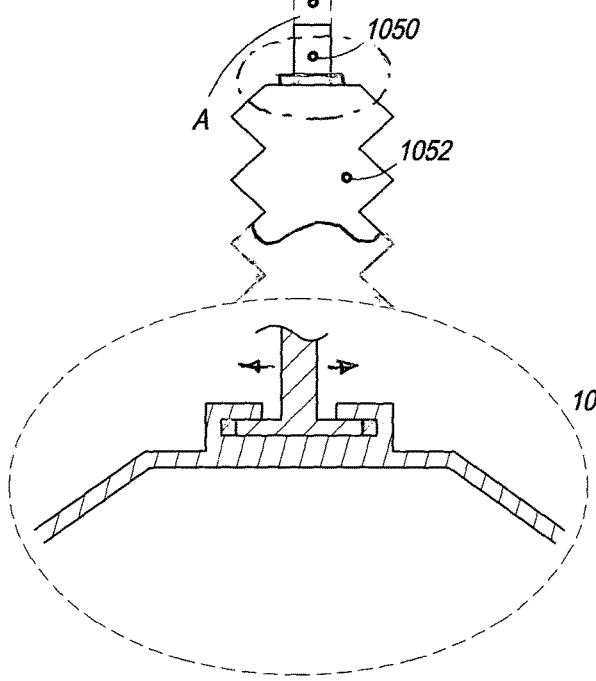
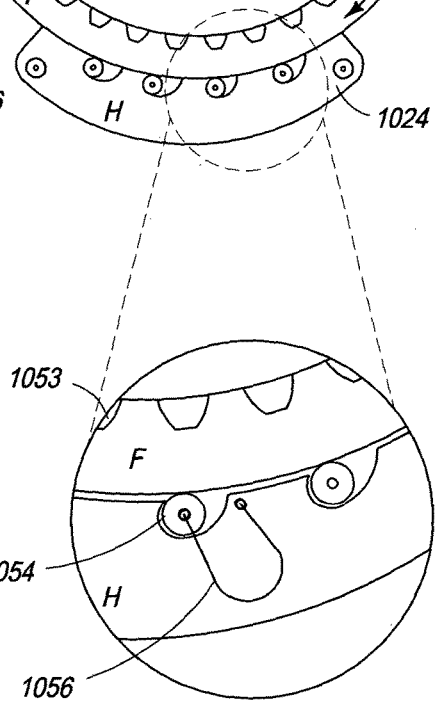
FIG. 10C
FIG. 10D

| ΔT [°C] | 6 | 50 | 100 | 150 |
|---|---|---|---|---|
| F [N] | 169.3 | 20.3 | 10.2 | 6.8 |

FIG. 12A

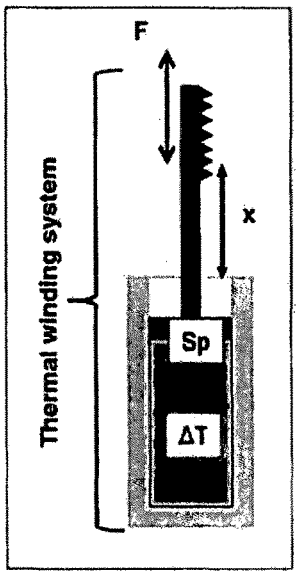
FIG. 12B
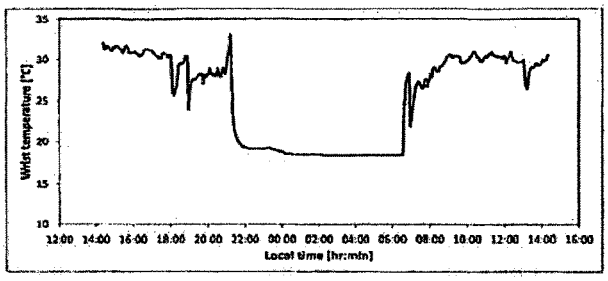
FIG. 12C
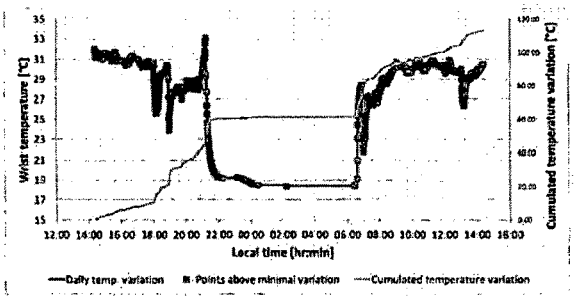
FIG. 12D
| | |
|---|---|
| Measurement period | 3. Winter |
| Measurement Duration | 4. 24 hr |
| Sampling rate | 5. 1 min |
| Cummulated ΔT | 6. 113.4°C |
| Compensated cummulated ΔT | 7. 61.4°C |
Evaluation of Delta T
FIG. 12E
| | | |
|---|---|---|
| $\Delta T_{min}$ | 0.1 °C | Corresponding liquid |
FIG. 12F

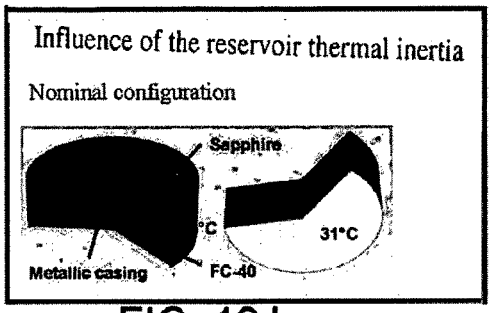
FIG. 12J
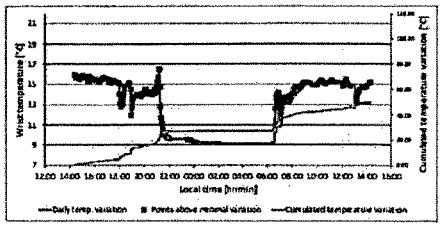
FIG. 12K
| Parameter | Value |
|---|---|
| $\Delta T_{min}$ | 0.1 °C |
Cumulated ΔT 0.0°C
FIG. 12L
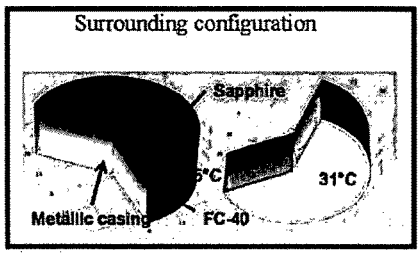
FIG. 12M
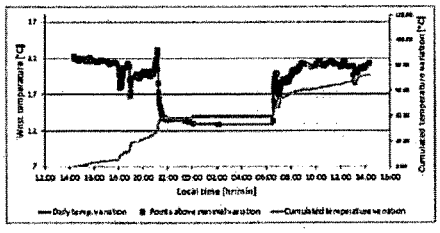
FIG.12N
| Parameter | Value |
|---|---|
| $\Delta T_{min}$ | 0.1 °C |
Cumulated ΔT 3.4°C
FIG. 12O
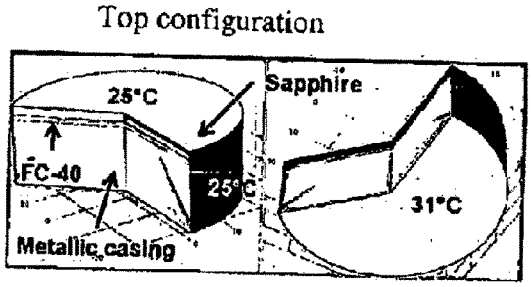
FIG. 12P

- TWS active surface: $S_p$ = 12.6 mm2 (r = 2 mm)
- Daily cumulated ΔT: ΔT = 33.4°C
- Temperature sensitivity: $\Delta T_{min}$ = 0.1°C
  - Required displacement from 18°C to 33°C : $x_{\Delta TW} \approx 3$ mm
  - Required displacement from -20°C to 70°C : $x_{\Delta TS} \approx 18$ mm
  - Required force: F ≈ 30 N
  - Minimal displacement required: $x_{min} \approx 20$ µm

| Main dimensions | |
|---|---|
| Reservoir | $D_r$ = Ø40 mm, $t_r$ = 1.3 mm (1600 mm3) |
| Bellow | $D_b$ = Ø4.9 mm, $L_b$ = 32.6 mm (410 mm3) |
| Buckling diaphragm | $R_d$ = Ø29.8 mm, $d_d$ = 1 mm (46 mm3) |

| Main system outputs | |
|---|---|
| Displacement resolution | 20 µm |
| Force on the bellow | 30.4 N |
| Daily cumulated ΔT | 33.4°C |
| Daily energy stored | 200 mJ |

| Main pressures | |
|---|---|
| Functional pressure | 24.2 bar |
| Buckling pressure | 31.1 bar |
| Bellow acceptable pressure | 33.7 bar |

TEMPERATURE DRIVEN WINDING SYSTEM

CROSS REFERENCE TO RELATED APPLICATIONS

This application is the National Stage of International Application No. PCT/IB2014/000373, filed Mar. 17, 2014, which claims benefit under 35 USC § 119(a), to U.S. provisional patent application Ser. No. 61/787,727, filed Mar. 15, 2013

COPYRIGHT & LEGAL NOTICE

A portion of the disclosure of this patent document contains material which is subject to copyright protection. The Applicant has no objection to the facsimile reproduction by anyone of the patent document or the patent disclosure as it appears in the Patent and Trademark Office patent file or records, but otherwise reserves all copyright rights whatsoever. Further, no references to third party patents or articles made herein are to be construed as an admission that the present invention is not entitled to antedate such material by virtue of prior invention.

BACKGROUND OF THE INVENTION

This invention relates to self winding systems for timepieces and more particularly relates to temperature differential driven self-winding timepieces, particularly wristwatches, which are wound in response to change in temperature.

Many, if not all, wrist watches, other than battery powered watches, receive energy for winding a main spring through a main spring barrel arbor from a winding weight or rotor in the watch which rotates in a direction due to movement of the watch wearer's arm. This movement of the wearer's arm produces acceleration of the winding weight or rotor about a pivotal axis. This results in bi-directional rotation of the shaft upon which it is mounted. The bi-directional rotation of this shaft is converted to unidirectional rotation of another shaft, which in turn winds the mainspring. A simple and common mechanism for converting bi-directional rotation of one shaft in a watch to unidirectional rotation of another shaft is known as a Pellaton mechanism. A Pellaton mechanism comprises a lever, which is bifurcated at one end. The bifurcated arms are acted upon by a rotating cam or eccentric pin to produce an eccentric oscillating motion. Spring loaded pawls on the lever engage a ratchet wheel at spaced apart locations on the ratchet wheel causing unidirectional rotation of the ratchet with the oscillating motion of the lever induced by the winding weight or rotor, e.g. U.S. Pat. Nos. 2,696,073 and 4,174,607.

Another mechanism for this type of mechanical conversion is known as a wig-wag mechanism. Here, a pinion on a bi-directionally rotatable shaft drives a linearly displaceable wig-wag gear. This gear engages one of two other gears dependent on the direction of rotation of the wig-wag gear. The gear arrangement is organized such that the mainspring barrel will always be driven in a direction to wind the mainspring.

Self-winding wrist watches generally have a power reserve of about one and one-half to three days. This is also called autonomy. The terms "autonomy" and "power reserve" refer to the time a self winding wrist watch will continue to run if fully wound, but not worn. Various efforts to increase the power reserve of a watch have been undertaken, but still result in the watch losing all power reserve after a period of time of not being worn. Hence, there is a need for a self-winding watch that does not rely on its inherent power reserve derived from motion of a user's arm. The invention solves these and other needs in the art.

SUMMARY OF THE INVENTION

The invention provides a drive system for energizing a device, that includes a bellows actuated drive, in which the bellows actuated drive provides linear forward and backward movement by fluid expansion and contraction of a fluid within a reservoir according to a temperature differential, and in which the reservoir is in fluid contact with the bellows.

It is another object of the invention to provide a drive system for energizing a timepiece. The system includes a circular or substantially circular reservoir, a fluid within the reservoir expanding or contracting as a function of a temperature differential, and one or more bellows in fluid connection with the reservoir providing motion in response to the expansion or contraction of the fluid.

It is yet a further object of the invention to provide a self winding timepiece. The timepiece includes a casing, a movement, a main spring for driving the movement and a winding mechanism for the main spring in the casing, and an energy source for driving the winding mechanism. The energy source includes a reservoir, shown in a C-shaped configuration in the figures (but such may take any geometric shape), a fluid within the reservoir that expands or contracts as a function of a temperature differential, and one or more bellows in fluid connection with the reservoir providing motion in response to the expansion or contraction of the fluid.

It is yet another object of the invention to provide a method of energizing a timepiece within a working temperature differential. The method includes providing a fluid filled reservoir in fluid connection with one or more bellows, and providing a temperature differential for expansion or contraction of the fluid within the reservoir and bellows to actuate motion of the bellows. These and other objects of the invention are further detail in the drawings, the brief description of the drawings, and detailed specification below.

BRIEF DESCRIPTION OF THE DRAWINGS

FIG. 10B is a top view illustration of a watch mechanism of the present invention.

FIG. 10C is an enlarged view of a portion of the watch mechanism of FIG. 10B.

FIG. 10D is an enlarged view of another portion of the watch mechanism of FIG. JOB.

Figure 1:
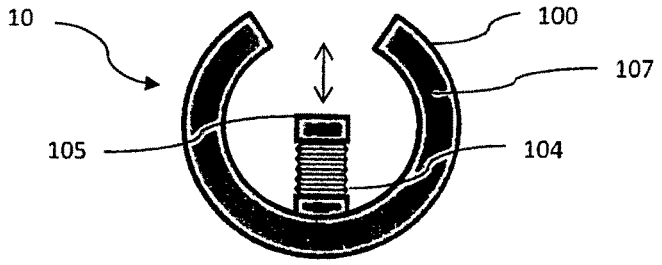
FIG. 1 is a top plan view of a section of a drive system of the invention.

Those skilled in the art will appreciate that elements in the Figures are illustrated for simplicity and clarity and have not necessarily been drawn to scale. For example, dimensions may be exaggerated relative to other elements to help improve understanding of the invention and its embodiments. Furthermore, when the terms 'first', 'second', and the like are used herein, their use is intended for distinguishing between similar elements and not necessarily for describing a sequential or chronological order. Moreover, relative terms like 'front', 'back', 'top' and 'bottom', and the like in the Description and/or in the claims are not necessarily used for describing exclusive relative position. Those skilled in the art will therefore understand that such terms may be interchangeable with other terms, and that the embodiments described herein are capable of operating in other orientations than those explicitly illustrated or otherwise described.

DETAILED DESCRIPTION OF THE PREFERRED EMBODIMENT

The following description is not intended to limit the scope of the invention in any way as they are exemplary in nature, serving to describe the best mode of the invention known the inventors as of the filing date hereof. Consequently, changes may be made in the arrangement and/or function of any of the elements described in the exemplary embodiments disclosed herein without departing from the spirit and scope of the invention.

The invention relates to a drive system 10 (FIG. 1) for a hydro mechanical horological time pieces, e.g. time piece(s) 400, 600 (FIGS. 4-8) and sub-systems thereof, as well as other devices described herein. These exemplary time pieces use a liquid 402 in their sub-systems for a functional purpose as is described below, and are constructed from, by way of example, titanium, titanium with shot-peened and satin-finished surfaces that are brushed to a certain color, e.g. pink gold, black DLC-coated titanium, and red gold. Of course, other metal and polymeric materials are also used in the time pieces. The time pieces are sized and dimensions, by way of example, at about 48 mm in circumference to about 18 mm in thickness or depth, and can include a tapered bezel. Of course, both smaller and larger dimensions can be used such that they are readily worn on a user's forearm or wrist.

The liquid 402, 616 (FIGS. 4 and 6) is used to display the hours on a circular tube 826 (FIG. 8) around the edge of the dial. A one or plurality of drive system 10 piston like devices 828, 830 (FIG. 8) are used in conjunction with bellows 404, 406 and some or all portions thereof are visible to a user on or near the bottom of the dial 408 and are used to push and pull the liquid 402 to show the time on a circular scale 410. Minutes 412 are displayed on a medium sized sub dial 414 that is optionally set near the center-top 416 of the time keeping device 400. On the side (right or left) of the time piece 400, an optional power reserve indictor 418 is located for the manual-wing mechanical movement. Some or all of the interior components 406, 406, 414, 418 of the time keeping device 400 are viewable through a transparent cover 420 which is located on the top surface 422 and also optionally a second transparent cover 502 may be located on the bottom surface 500 (FIG. 5) of the time keeping device 400.

Figure 6:
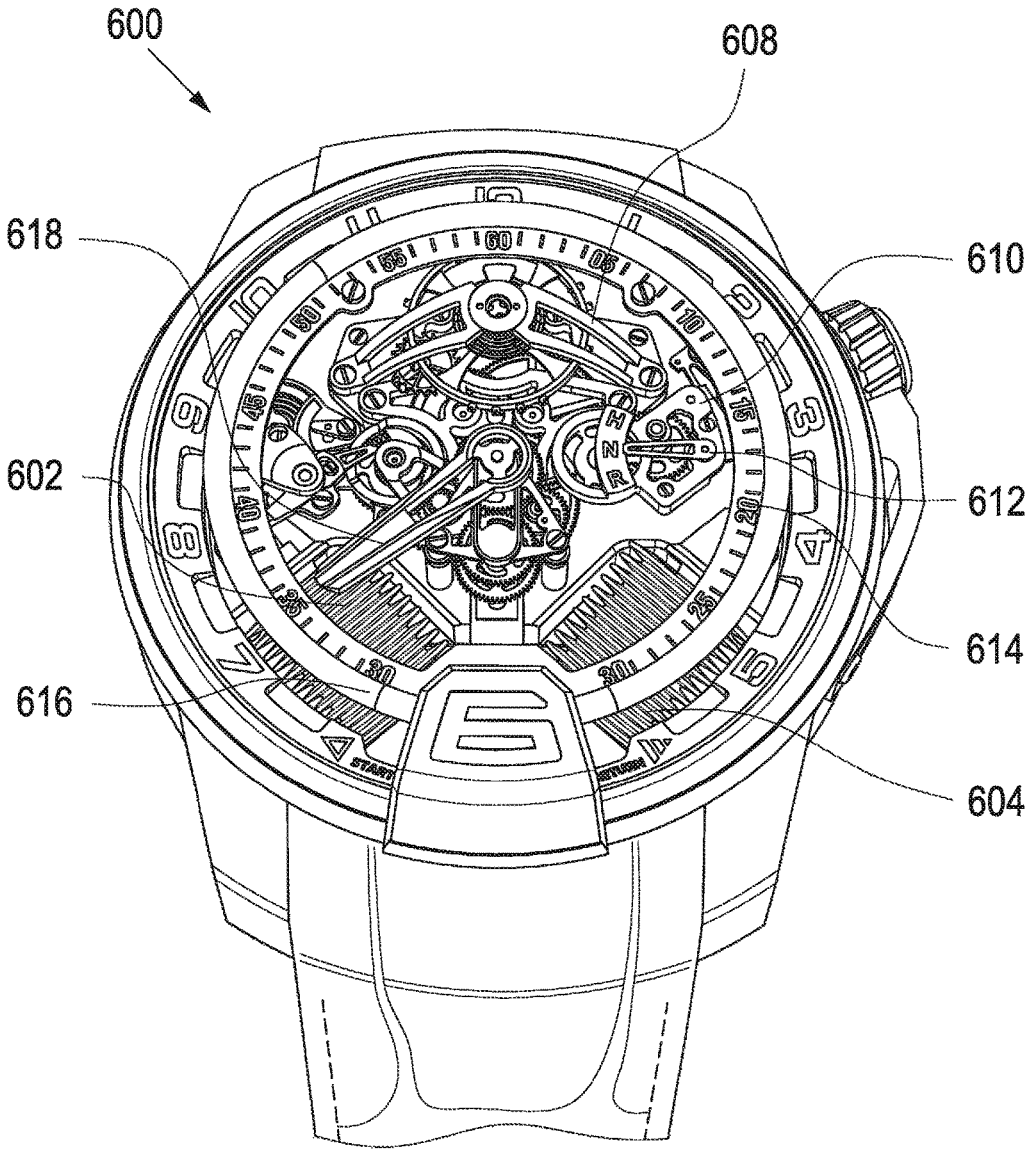
FIG. 6 is a top perspective photograph of a time piece variant incorporating a drive system of the present invention.
Figure 7:
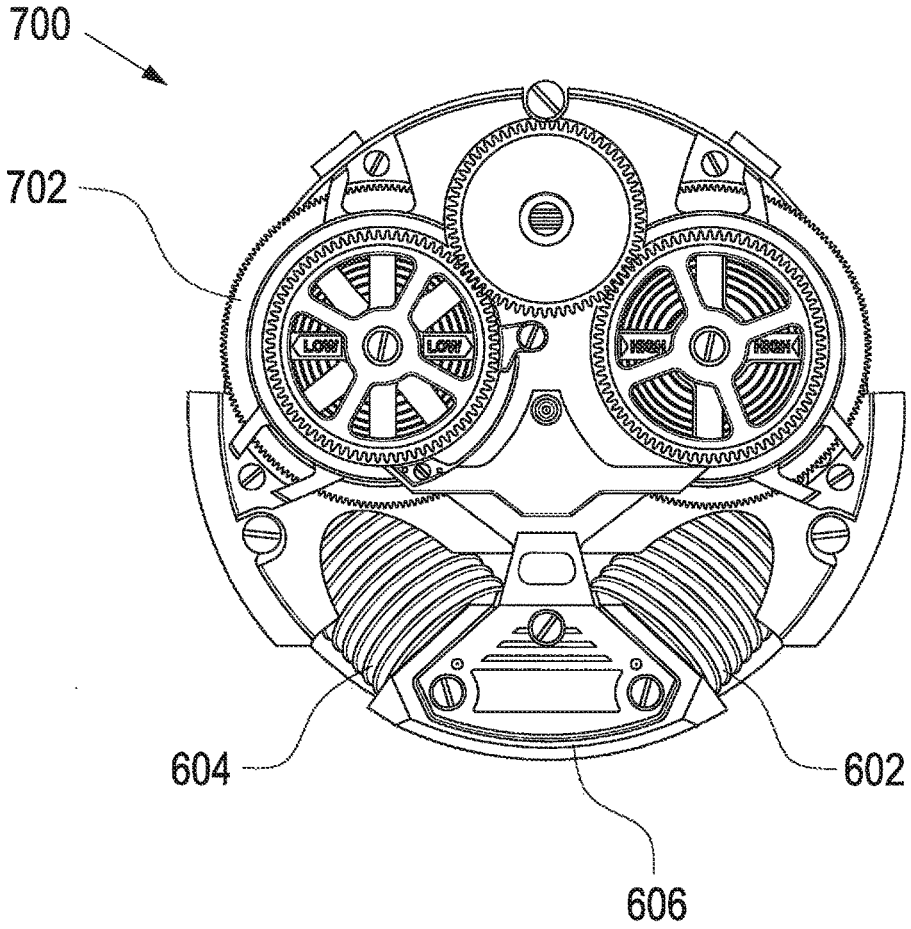
FIG. 7 is a rear top view photograph of a time piece variant of FIG. 6 incorporating a drive system of the present invention.

A time keeping device 600 is illustrated in FIGS. 6 and 7 in a variant of the invention. Bellows 602 and 604 are positioned at about the 6 o'clock position and in a "V" shaped configuration. This configuration optimises the integration of the interface 606 that connects the watch mechanisms sub-systems with the fluidic system as described below. Mirroring the pair of bellows 602, 604, a balance spring (not shown) resides at the midday position on a black bridge 608. At the 3 o'clock position is an "H-N-R" crown position indicator 610 and it is counterbalanced by the presence of another hand 612 as a component of a temperature indicator 614. Once the watch is worn, this function enables the user to accurately find out when the fluid 616 has reached a functional optimum temperature range. Fluid 616 obeys a set of watchmaking specifications. Fluid 616 is provided in a variety of colours, e.g. red, yellow, green, and provides homogenous resistance to vibrations, shocks and temperature changes, and no alteration in the long term, foolproof water resistance of device 600. When a fluorescein-loaded liquid 616 has done a complete round (rotation) and gets to the 06:00-18:00 position, the issuing pump compresses, while the bellows 602, 604 receiver expands, generating resistance and consequently an increased energy requirement.

Figure 8:
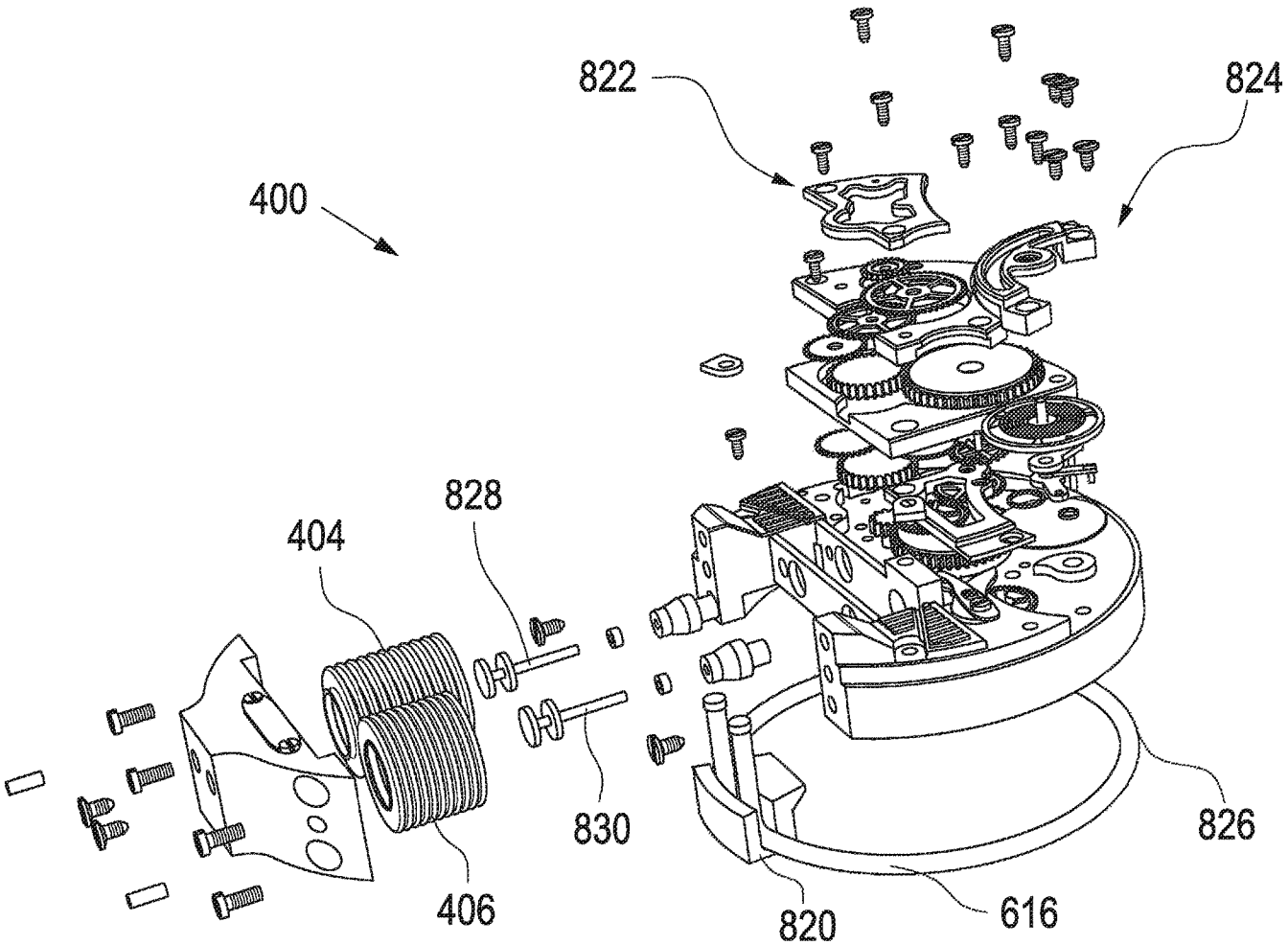
FIG. 8 is an exploded rear perspective view of the time piece variant of FIG. 4.

Bellows 602, 604 are made from an extremely fine alloy and are highly supple and resistant. In another variant, bellows 602, 604 are made of a highly resistant, flexible electro-deposited alloy, each driven by a piston(s) 828, 830 (FIG. 8). The shape of the bellows 602, 604 allows for the reduction of energy required for their compression, absorbs shocks and ensures solid waterproofing. In the centre, a minute hand 618 is configured and designed in stages to perfectly fit the structure of the fluidic system and it is designed to jump after 30 minutes to avoid the bellows 602, 604.

FIG. 7 illustrates the rear 700 of the internal structure 702 of device 600. In one variant of the invention, the self-winding timepiece 600 further includes a plurality of bellows 602, 604 in which at least two of the bellows 602, 604 are arranged with respect to one another at an angle of greater than 1 degree to less than about 180 degrees. In another variant, at least two of the bellows 602, 604 are oriented with respect to one another at an angle of greater than about 45 degrees to less than 110 degrees. In yet another variant, bellows 602, 604 are arranged with respect to one another at an angle of 90 degrees. It is appreciated that some of the mechanically interacting components of the bellows 602, 604 also have the same angular orientation as those of the bellows 602, 604.

FIG. 8 is a rear exploded perspective view of the time piece 400. Precise micro-liter quantities of fluid 402 are used in the closed circuit to provide water resistance. Due to the link between the crown and the liquid 402, the time-setting system is designed in order to avoid the liquid 402 moving around too fast and damaging the meniscus (not shown). A mechanical movement mechanism 822 is situated in the upper part 824 of the watch 400, and propels a cam, which pushes the piston and activates the bellows 404, 406. The interface provided between the mechanical movement and the hydro system is in a closed, waterproof circuit. Both are assembled separately to keep them independent, and then made to operate simultaneously.

Figure 2:
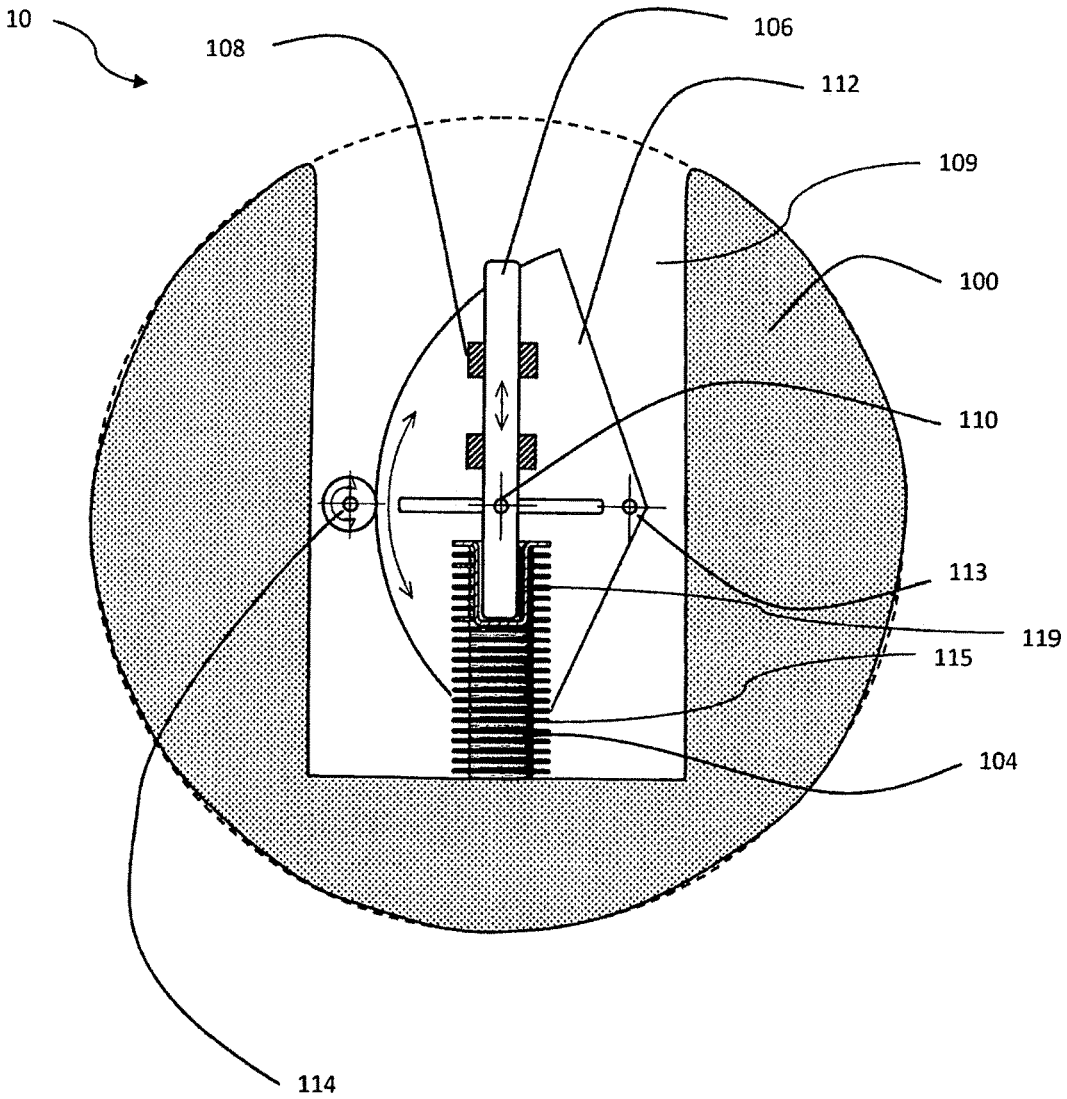
FIG. 2 is a top plan view of a section of another embodiment of a drive system of the invention.

Referring now to FIG. 1, the invention provides a drive system 10 for energizing a device. The drive system 10 includes a bellows 104 actuated drive interface 105. The bellows actuated drive interface 105 provides linear translational forward and backward movement (as shown in FIGS. 1 and 2) by fluid expansion and contraction of a heat transfer fluid 107 according to a temperature differential. Fluid 107 is located within a rigid reservoir 100. The reservoir 100 is in fluid contact with bellows 104. The reservoir 100 is constructed of any suitable material that acts as a heat conduit so that temperature differentials manifested externally of the drive are thermally conveyed to the fluid 107. It is appreciated that bellows 104 is constructed from flexible, elastomeric materials which permit the bellows 104 to move in an axial direction with respect to the bellows main body upon changes in volumes of the fluid 107. An optional mechanical interface connects bellows 104 to rigid reservoir 100 (not shown). Bellows 104 includes an accordion style body in one variant of the invention as illustrated in the Figures.

Drive interface 105 can take one of several forms according to the use of the drive system. An exemplary drive interface 105 is illustrated in FIG. 2. Rigid reservoir 10 is sized and dimensioned in a variety of geometric configurations. As shown in FIGS. 1 and 2, reservoir 10 takes on a substantially circular, tubular configuration (e.g. substantially C-shaped or substantially U-shaped) having the following dimensions which make it suitable to energize a wristwatch as well as the following properties of the fluid within the reservoir: exterior diameter—about 40 mm, interior diameter about 30 mm, thickness about 5 mm, reservoir angle about 270 degrees, reservoir volume 8247 $mm^3$ or there about, surface interface 19.63 $mm^2$ or thereabout (with disc diameter of 5 mm or thereabout), a coefficient of dilation (1/degrees C.)–0.0012 (with 3M Flourinert™ Electronic Liquid FC-40), and an expansion per 1 degree C. of 9.90 mm3, a movement at the interface of 0.50 mm, an expansion at 3 degrees C. (29.69), and a movement at the interface of 1.51 mm, an expansion per 50 degrees C. of 494.80 $mm^3$—with a movement at the interface of 25.20 mm (from 0 degrees C. to +50 degrees C.), and an expansion at 90 degrees C. of 890.64 mm3 (from −20 degrees C. to +70 degrees C.) with a movement at the interface of 45.36 mm. It is understood that the system includes a fluid with a high thermal expansion coefficient in another variant of the invention. For this reason, in cases where the device must withstand large temperature variations, the shape and construction of the bellows 104 as well as its stiffness is adapted or modulated, to prevent damage to the device at the temperature extremes.

Figure 3A:
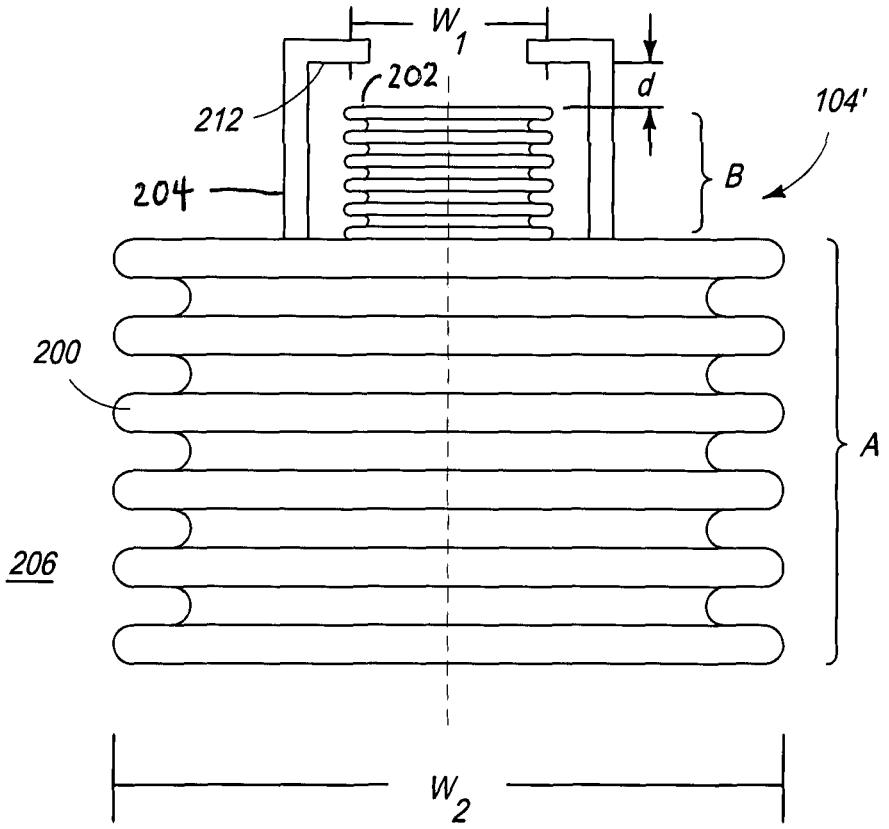
FIG. 3A is a front view of a compound bellows mechanism used in the invention.
Figure 3B:
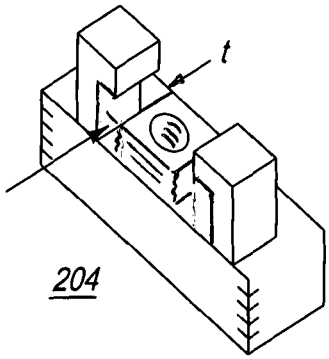
FIG. 3B is a perspective view of the compound bellows mechanism used in the invention
Figure 4:
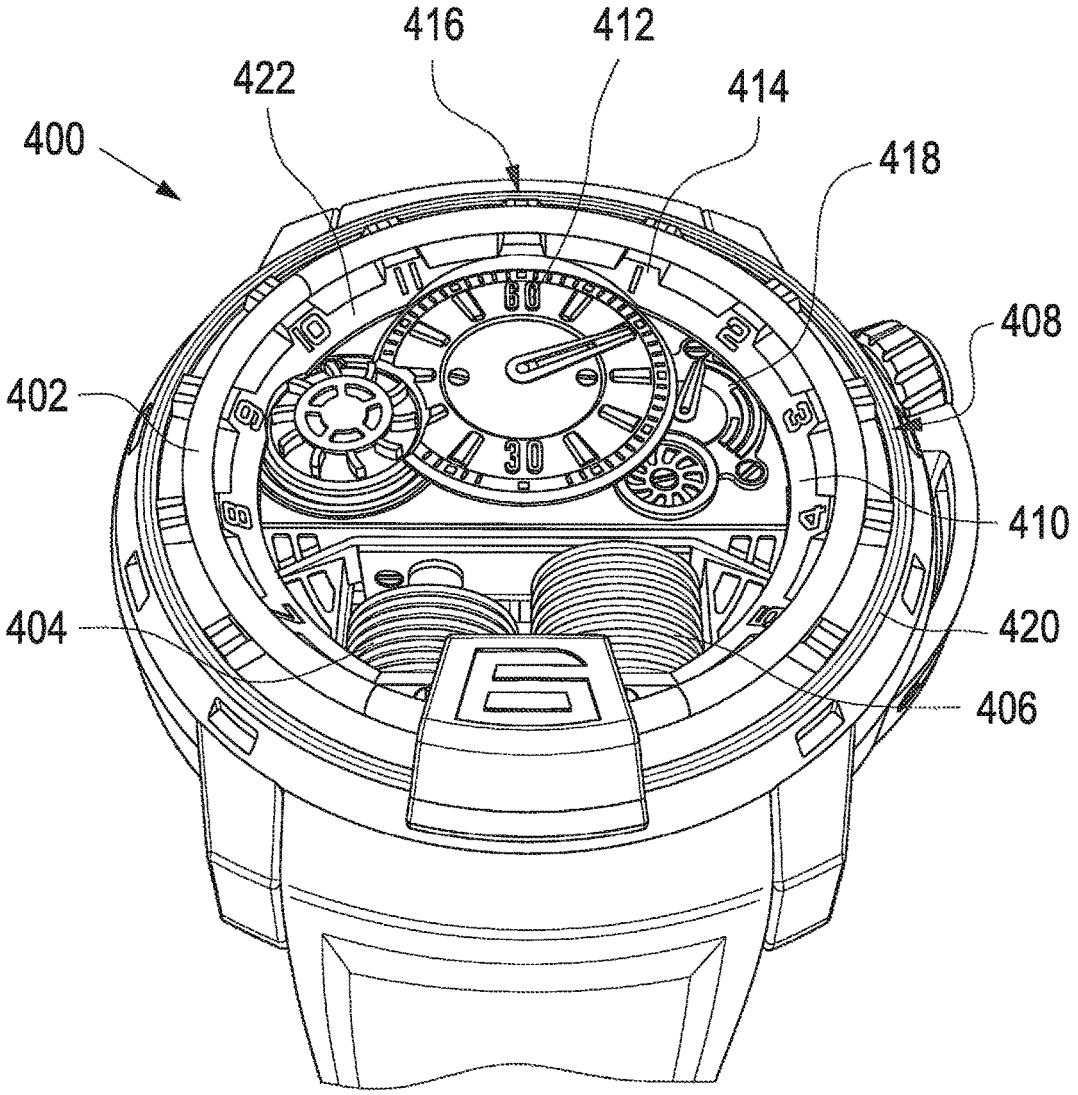
FIG. 4 is a top perspective photograph of a time piece incorporating a drive system of the present invention.
Figure 5:
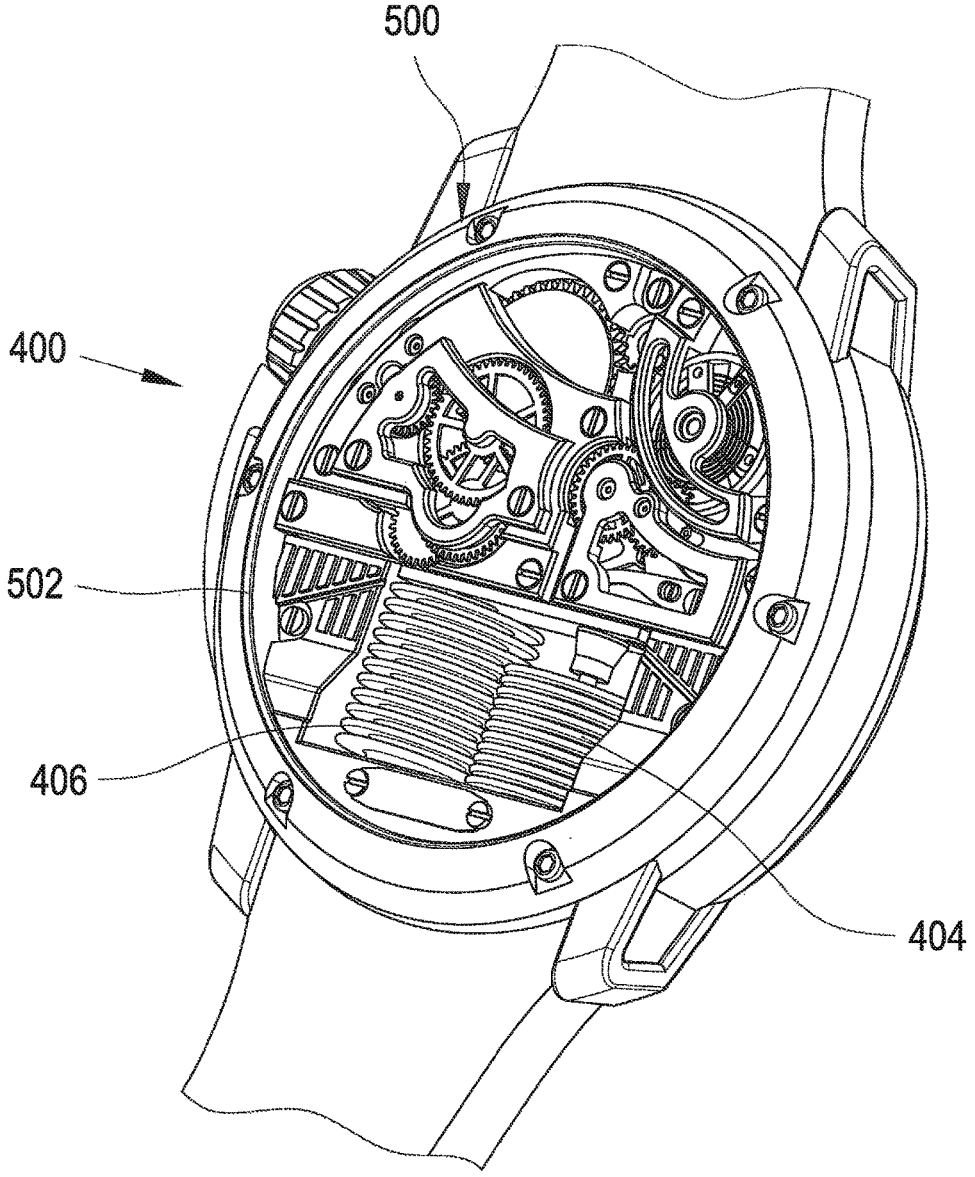
FIG. 5 is a rear perspective photograph of a time piece of FIG. 4 incorporating a drive system of the present invention.

Referring now to FIGS. 3A and 3B, as an example, a compound bellows 104' is provided, made up of a large bellows 200 and a smaller bellows 202. Of course, it is understood that the sizes and constructions of bellows 200, 202 can vary one from another to obtain the desired functions. The compound bellows 104' has variable cross-sections at levels 204 and 206 as shown in the figures. In this embodiment, the stiffness of zone A (of large bellows 200) is significantly higher than the stiffness of zone B (of the smaller bellows 202). Hence, it is also appreciated that the stiffness of the material or three dimensional conformation of the bellows can also be varied from one another. In normal operation, which involve temperature extremes or variations of perhaps 10 to 15 degrees C., the small bellows is active to actuate the gear 112. Where the device 10 is exposed to high temperature extremes, the small bellows 202 expands until its top 210 abuts against the stop arms 212, which prevent over expansion beyond it's elastic range. It is also appreciated that the bellows can be constructed from materials that provide varied elastic ranges one from another. With increasing temperature, the large bellows 200 takes over and expands much less, thereby controlling the total expansion of the system so that it remains within the elastic range of the compound bellows 104' while avoiding excessive expansion that could damage the device 10.

Note that the thickness "t: of the compound bellows 104' may be small compared to the widths w1 and w2 of its components, in order to have a lower profile, enabling the device to be placed within a watch casing.

Drive system 10 is used to power a variety of devices which include, by way of further example: a wristwatch, a pocket watch, a timepiece, a medical device, an implantable medical device, a cardiac rhythm management device, a hearing aid, a medical micro-injector, a sensor, and a biometric transmitter. Hence, the invention is not limited to use for energizing a wristwatch in one variant of the invention, but rather has a variety of device applications.

In reference to FIG. 2, and by way of further example, drive system 10 is used to energize a timepiece. The drive system 10 includes a substantially U-shaped, closed reservoir 100. The U-shaped reservoir includes an inner area 109 which includes the various drive interfaces 105 that are used in the invention. The drive interface 105 illustrated in FIG. 2 is only shown by way of example. Other exemplary drive interfaces 105 include movement conveying mechanisms such as a cam system, a genouillère system, and a multi-lever system.

A fluid 102 is contained within the reservoir 100. The fluid 102 within the reservoir 100 (which is rigid and constructed from a rigid, transparent or translucent material) expands or contracts as a function of a temperature differential. Various fluids are used in the invention. By way of example, fluids useful in the device, system and method of the present invention are: non-corrosive, chemically un-reactive, and essentially chemically inert. The fluids are non-explosive, non-flammable and non-toxic to life forms particular humans as through exposure to vapor or liquid through skin contact, inhalation and ingestion. It is useful that the fluids maintain a single phase (e.g. liquid) during operating conditions. Exemplary fluids comprise relatively inert fluorinated organic compounds, preferably those in which all or essentially all of the hydrogen atoms are replaced by fluorine atoms. The prefix "per-fluoro" includes compounds in which all, or essentially all, of the hydrogen atoms are replaced by fluorine atoms.

The fluorinated, inert fluids are one or a mixture of fluoroaliphatic compounds having from about 5 to about 18 carbon atoms or more, and optionally containing one or more catenary heteroatoms, such as divalent oxygen, trivalent nitrogen or hexavalent sulfur. Suitable fluorinated, inert fluids useful in this invention include, for example, perfluoroalkanes or perfluorocycloalkanes, such as, perfluoropentane, perfluorohexane, perfluoroheptane, perfluorooctane, perfluoro-1,2-bis(trifluoromethyl)hexafluorocyclobutane, perfluorotetradecahydrophenanthrene, and perfluorodecalin; perfluoroamines, such as, perfluorotributyl amine, perfluorotriethyl amine, perfluorotriisopropyl amine, perfluorotriamyl amine, perfluoro-N-methyl morpholine, perfluoro-N-ethyl morpholine, and perfluoro-N-isopropyl morpholine; perfluoroethers, such as perfluorobutyl tetrahydrofuran, perfluorodibutyl ether, perfluorobutoxyethoxy formal, perfluorohexyl formal, and perfluorooctylformal; perfluoropolyethers; hydrofluorocarbons, such as pentadecafluorohydroheptane, 1,1,2,2-tetrafluorocyclobutane, 1-trifluoromethyl-1,2,2-trifluorocyclobutane, 2-hydro-3-oxaheptadecafluorooctane. Suitable fluorinated, inert fluids include those commercially available from 3M Company under the trade mark "Fluorinert" and include fluorinated, inert fluids taught in U.S. Pat. Nos. Re 34,651, 5,317,805, 5,300,714, 5,283,148, 5,251,802, 5,205,348, 5,178,954, 5,159,527, 5,141,915, 5,125,978, 5,113,860, 5,104,034, 5,089,152, 5,070,606, 5,030,701, 5,026,752, 4,997,032, 4,981,727, 4,975,300, 4,909,806, the disclosures of which are incorporated herein by reference. Flourinert fluids include FLOURINERT FC-40, FC-43, FC-5311, FC-70 and FC-5312 having boiling points of 155 degrees C., 174 degrees C., 215 degrees C., 215 degrees C. and 215 degrees C., respectively. Most preferred of these is 3M FLUORINERT™ FC-40. Of course, it is appreciated that other fluids may also used in the invention provided they have the properties suitable for expansion and contraction necessary to enable the proper working of the bellows 104 within desired mechanical parameters.

Bellows 104 is disposed within the U-shape in area 109 and area 109 optionally includes a plurality of fins 115, e.g. expansion and/or contraction fins. It is appreciated that bellows 104 is constructed from suitable elastomeric material that is compatible with fluid 102. Bellows 104 further includes a mechanical interface portion 119, and bellows 104 is in fluid connection with reservoir 100 providing axially motion in response to the expansion or contraction of the fluid 102. In the variant in FIG. 2 of the invention, drive system 10 further comprises slider 110 and a first half-wheel 112 having a first diameter, in which the bellows 104 transfers the linear movement of the bellows 104 through the slider 110. A second-wheel 114 that has a second diameter is also provided. The second wheel 114 is driven by the first half wheel 112. It is appreciated that the diameter difference between first half wheel 112 and second-wheel 114 multiplies the movement to provide a multiplied movement. It is also understood that half wheel 112, and wheel 114 contain teeth appropriately sized and dimensioned to interact with each other. The multiplied movement is used to recharge a spiral spring (not shown) in one variant. In a second variant, the multiplied movement is used to actuate and energize an electrical current generator (not shown). Of course other sub-systems can be also be actuated depending on the device the drive system 10 is used in.

The drive system 10 further comprises a piston 106 actuated by the bellows 104. The piston 106 provides linear forward and/or backward movement as indicated by the arrows in FIG. 2, A piston guide 108 controls the axial movement of the piston 106. While this exemplary configuration of the bellows 104 interface with other mechanical features shown in FIG. 2, they are suitable for use in a wristwatch and the like, and it is appreciated that other mechanisms (be they electrical/mechanical or electro-mechanical) can be driven using the drive system of the present invention.

As discussed, the invention also provides self winding timepiece(s) 400, 600. The timepieces 400, 600 include a casing, a movement, a main spring for driving the movement and a winding mechanism for the main spring in the casing, and an energy source for driving the winding mechanism. The energy source is described herein and includes a substantially U-shaped reservoir 100 (of course, other geometric configurations are also used herein and can be substantially circular or any suitable shape which fits in the wristwatch casing), a fluid 102 within the reservoir expanding or contracting as a function of a temperature differential, and a bellows 104 disposed within the U-shape. The bellows 104 is in fluid connection with reservoir 100 so that the bellows 104 provides axially motion in response to the expansion or contraction of the fluid 102, thus moving piston 106, and half wheel 112 (which pivots at pivot 113).

It is appreciated that the invention described herein also provides a method of energizing a timepiece within a working temperature differential. The working temperature differential is provided by changes in user body temperature, e.g. as per a circadian rhythm, and changes in ambient external temperature. These changes occur in night and day cycles, due to temperature fronts, between areas exposed to sun and wind and the like. The method includes providing a fluid filled reservoir in fluid connection with a bellows, and providing a temperature differential for expansion or contraction of the fluid within the reservoir and bellows to actuate linear motion of the bellows. As described above with respect to FIGS. 1 and 2, it is appreciated that a variable transmission rate system is provided working in concert and actuated by bellows 104. The variable transmission rate system allows the timepiece to withstanding a large temperature range differential without destruction of the system, while simultaneously keeping a sufficient transfer rate around the working temperature differential.

Figure 9A:
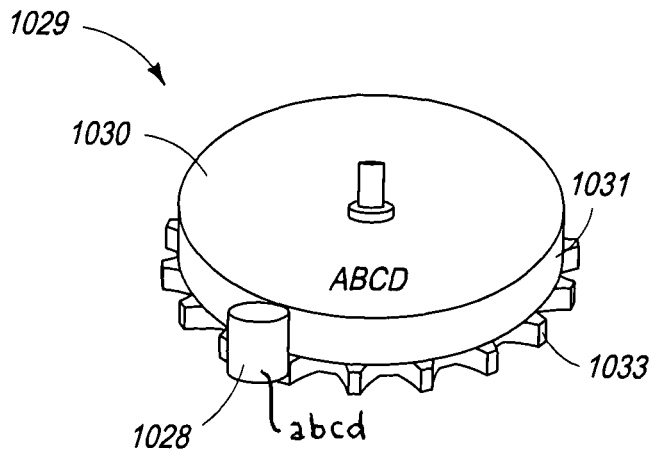
FIG. 9A is a side perspective view of a toothed gear and gear with soft functional surface sub-system used in the mechanism illustrated in FIG. 9B.
Figure 9D:
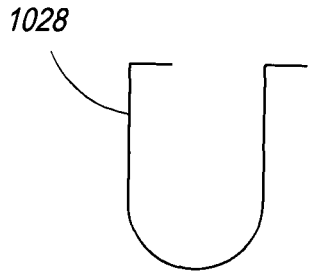
FIG. 9D is a side perspective view of the spring of the invention.
Figures 9B, 9C:
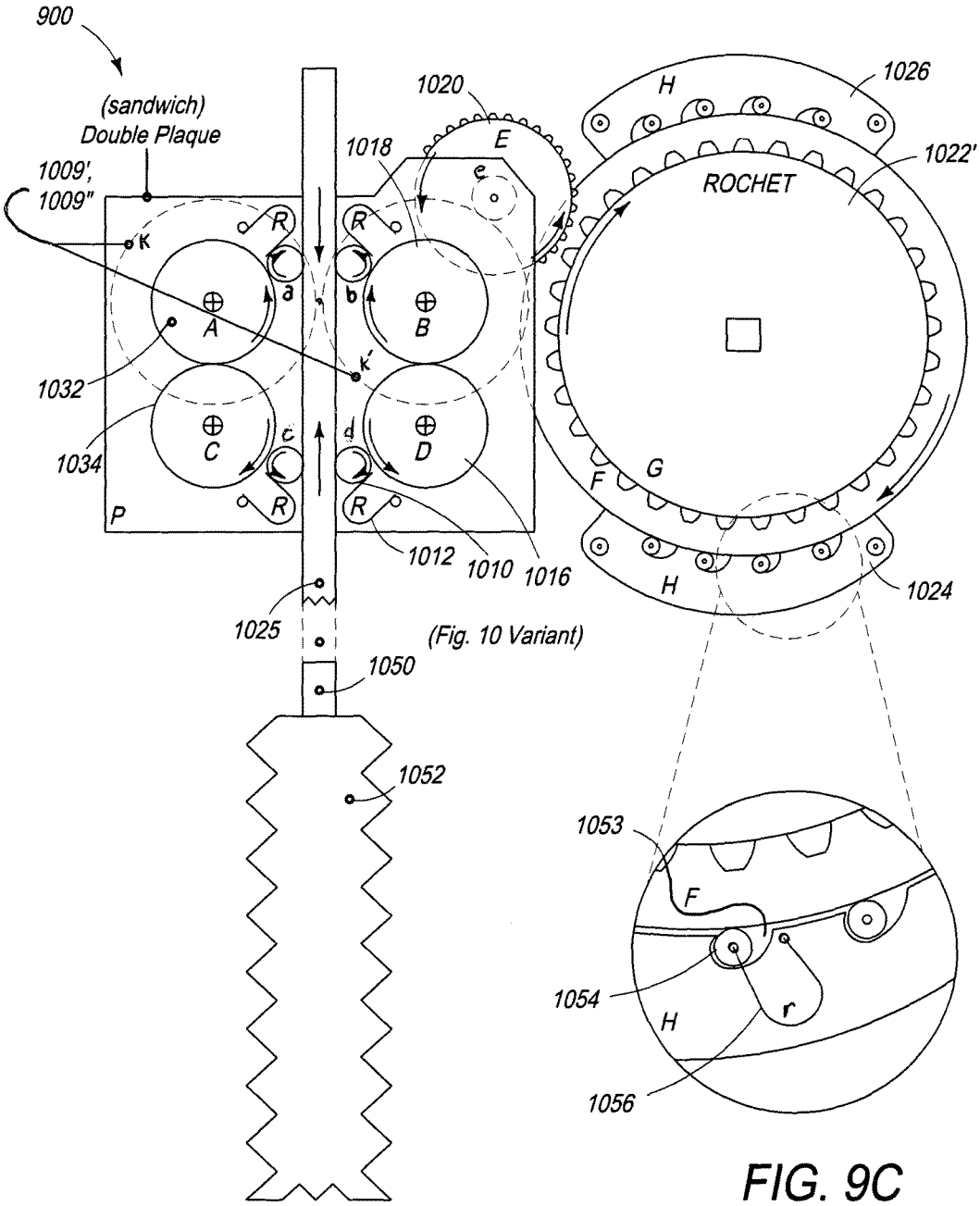
FIG. 9B is a top view illustration of a sub-system of a watch mechanism of the present invention.
FIG. 9C is an enlarged view of a portion of the watch mechanism of FIG. 9B.

Now referring to FIG. 9A, which is a side perspective view of another variant of tooth gear and gear mechanism and sub-system 900 also illustrated in another variant in FIGS. 10A-10E. FIG. 9B is a top view illustration of a watch mechanism/system 900 of the present invention. The purpose of the system 900 is to capture the going back and forth linear movement of the rectangular rod T 1002 from a displacement of about 20 microns (of course greater or lesser displacements are also captured depending on the requirements of the watchmaker) to wind a clock spring (not shown) placed in the ratchet G assembly 1022'. The explanation focuses on the right side of the axis T 1006. (as illustrated in FIG. 10, but referred to in the description of FIG. 9B). The left side mechanism 1008 with toothed gear/gear with soft frictional surface sub-systems B 1018 and D 1016 is a mirror image replication of the right side mechanisms A 1032, C 1034, whose aim is to stabilize the system 1000. Hence, the gear sub-systems described herein include mirror image sub-systems in relation to the axis of movement of rod T 1002

While 4 sub-systems A-D are shown, a smaller or greater number of sub-systems are also used in variants of the invention. The system 900 also includes a system of k plates 1009' and 1009". When rectangular rod T 1002 is moving in the direction 1 (through, for example thermal expansion or thermal contraction of the fluid in the bellows 1052 which is connected to piston 1050), gear with soft frictional surface d 1010 (also shown in FIG. 10 B) is driven by friction in the same direction, and is constrained by the spring R 1012. The various gear 1028, 1030 (Aa, Bb, Cc, Dd) combinations rotate as shown in each of the respective arrows for these gear systems. The more it advances, the more the space between rectangular rod T 1002 and toothed gear D 1014 decreases, so the friction between gear d 1010 and rectangular rod T 1002/toothed gear D 1014 increases. Toothed gear D 1016 is driven as the arrow indicates. Following the gear-trains D 1016, B 1018 and E/e 1020 (Gear sysb-subsystem E/e rotates and is in rotational engagement as shown in FIG. 9B, as are the other gear combinations and sub-systems shown, the displacement is amplified and sent to ratcheted gear G 1022'. Ratcheted gear G 1022' is retained by H brackets 1024, 1026, thanks to friction system 1027 described in I 1025 in FIG. 10D which is an exploded view of area A.

Now referring to FIG. 9C (and also in FIG. 10C), retaining systems 1026 and 1024 include a plurality of cavities 1053 in which rollers 1054 rotatably reside along the smooth circumference of gear 1022'. Also included is retaining element 1056. Friction sub-system 1027 (FIGS. 9A-10E)) includes a connection system to rod 1002, and a bellows system or other system as described herein. When rectangular rod T 1002 advances in direction 2, gear with soft frictional side surface b 1028 is driven by friction in this direction and drives the drive train B 1030, e/E, G, as before. When the direction is opposite, gear with soft frictional side surface d 1032 (similarly for the other gear combinations in one variant) dis-engages from D and glides over surfaces of T 1002 and tooth gear system D 1016, and even more as the displacement 2 increases. Whatever direction 1 or 2, the ratchet G 1022 rotates in the direction shown.

Now referring to FIG. 9A which is a perspective view of a tooth gear 1030 and gear with soft functional surface 1028 sub-system 1029 used in the mechanism and system illustrated in FIG. 9B. It is appreciated that gear 1030 has two portions thereof, a portion that has a smooth, frictionally engaging circumferential portion 1031 of a sufficient height to accommodate gear or roller 1028, and a toothed portion 1033 for mated, rotational engagement of the other elements of system 900. It is further appreciated that soft functional surface system gears a, b, c, d are replicated in each of the drive train systems A 1032, B1018, C 1034, D 1016, and include tooth gears A, B, C and D, of which an exemplary gear 1030 is illustrated in FIGS. 9A and 10A.

Each respective sub-system has a combination of a respective larger gear, a mating smaller gear, and a spring r, and all sub-systems operate in various rotational relations to one another. For example, sub-assembly large gear A rotating counter-clockwise, sub-assembly large gear C rotates clockwise. For example, sub-assembly large gear D rotating counter-clockwise, sub-assembly large gear B rotates clockwise. While smaller gears rotate as follows: a—clockwise, b—counter clockwise, c—counterclockwise, and d—clockwise. At the same time gear subsystem E/e rotates counter-clockwise, while gear 1022' rotates clockwise. It is appreciated that other rotational variant can also be used in keeping with the invention.

Now referring to FIG. 9C which is an enlarged view of a portion of the watch mechanism of FIG. 9B, and includes detail concerning the construction of element 1024, which is further replicated in element 1028. While elements 1024 and 1028 are shown as a pair located at opposite sides of gear 1022' is it appreciated that a single or three or more of such elements are also used in variants of the invention. Now referring to FIG. 9D, which is an enlarged view of another portion of the watch mechanism of FIG. 10B. FIG. 10E is a top view of spring r or retaining clip r 1028. An idler gear is urged in a relationship with spring r 1028'. It is appreciated that system 900 winds when it goes in one direction, and slips in the other direction. Hence, system 900 manages movement in both directions. Overall, The mechanism is symmetrical around a cylindrical/or rectangular rod. In both directions a clock spring is being wound, so that there is a slipping arrangement and mechanism provided and configured with its various sub-systems transversely so it will wind the watch in both directions.

Figure 10A:
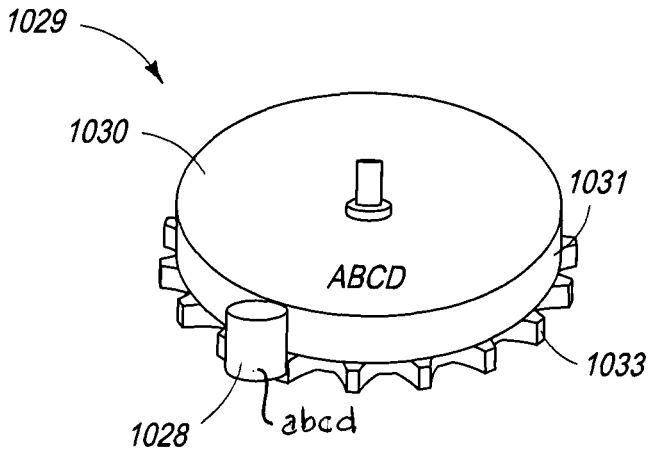
FIG. 10A is an exploded view of a tooth gear and gear with soft functional surface sub-system used in the mechanism illustrated in FIG. 10B.
Figure 10E:
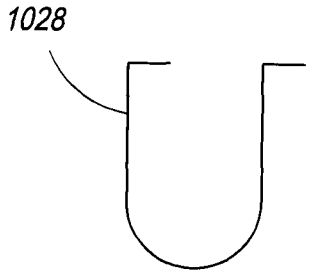
FIG. 10E is a side perspective view of the spring of the invention.

Now referring to FIG. 10B which is a top view illustration of a watch mechanism/system 1000 of the present invention. The purpose of the system 1000 is to capture the going back and forth linear movement of the rectangular rod T 1002 from a displacement of about 20 microns (of course greater or lesser displacements are also captured depending on the requirements of the watchmaker) to wind a clock spring (not shown) placed in the ratchet 1004. The explanation focuses on the right side of the axis T 1006. The left side mechanism 1008 with toothed gear/gear with soft frictional surface systems B and D is a mirror image replication of the right side mechanisms 1008, whose aim is to stabilize the system 1000. The system 1000 also includes plate 1009. (See, also, FIG. 11, heat transfer conduit 1106) When rectangular rod T 1002 is moving in the direction 1 (through, for example thermal expansion of the fluid in the bellows), gear with soft frictional surface d 1010 is driven by friction in the same direction, constrained by the spring R 1012. The more it advances, the more the space between rectangular rod T 1002 and toothed gear D 1014 decreases, so the friction between gear d 1010 and rectangular rod T 1002/toothed gear D 1014 increases. Toothed gear D 1014 is driven as the arrow indicates. Following the gear-trains D 1016, B 1018 and WE 1020, the displacement is amplified and sent to ratcheted G 1022, which is retained by H brackets 1024, 1026, thanks to friction system 1027 described in I 1025 in FIG. 10D which is an exploded view of area A. Friction system 1027 includes a connection system to rod 1002, and a bellows system or other system as described herein. When rectangular rod T 1002 advances in direction 2, gear with soft frictional side surface b 1028 is driven by friction in this direction and drives the drive train B 1030, e/E, G, as before. When the direction is opposite, gear with soft frictional side surface d 1032 disengages from D & glides over surfaces of T 1002 and tooth gear system D 1034, and even more as the displacement 2 increases. Whatever direction 1 or 2, the ratchet G 1022 rotates in the direction shown. Now referring to FIG. 10A which is an enlarged view of a tooth gear and gear with soft functional surface system used in the mechanism and system illustrated in FIG. 10B. It is appreciated that soft functional surface system gears a, b, c, d are replicated in each of the drive train systems A 1032, B1018, C 1034, D 1016, and include tooth gears A, B, C and D, of which an exemplary gear 1030 is illustrated in FIG. 10A. Now referring to FIG. 10C which is an exploded view of a portion of the watch mechanism of FIG. 10B, and includes detail concerning the construction of element 1024. Now referring to FIG. 10D which is an enlarged view of another portion of the watch mechanism of FIG. 10B. FIG. 10E is a top view of spring R. An idler gear is urged in a wedging relationship with Spring R. It is appreciated that system 1000 winds when it goes in one direction, and slips in the other direction. Hence, system 1000 manages movement in both directions. Overall, The mechanism is symmetrical around a cylindrical/or rectangular rod. In both directions a clock spring is being wound, so that there is a slipping arrangement and mechanism provided and configured with its various sub-systems transversely so it will wind the watch in both directions.

It is further appreciated that there are alignment problems because the rod 1002 has to be free and be capable of moving freely, because friction is also being applied to it. Symmetrical system 1000 is designed so forces are the same on both sides of the rod 1002. However, there may also be transverse movement or parallel to the axis movement of the rod 1002. An optional flange or other retaining mechanism is also provided so that the flange permits limited side to side side movement of rod 1002. It could be directly attached to the system 1000 or components thereof. The bellows system as described herein, in one variant of the invention, is laid on top of or over the system/mechanism 100, and the bellows system or components thereof act against an arm that comes off the rectangular rod. It is appreciated that the sandwiched arrangement of the bellows systems and systems 1000 permit a watch to be more compact. Laying the bellows over the mechanism/system 1000 also make it more compact.

Figure 11:
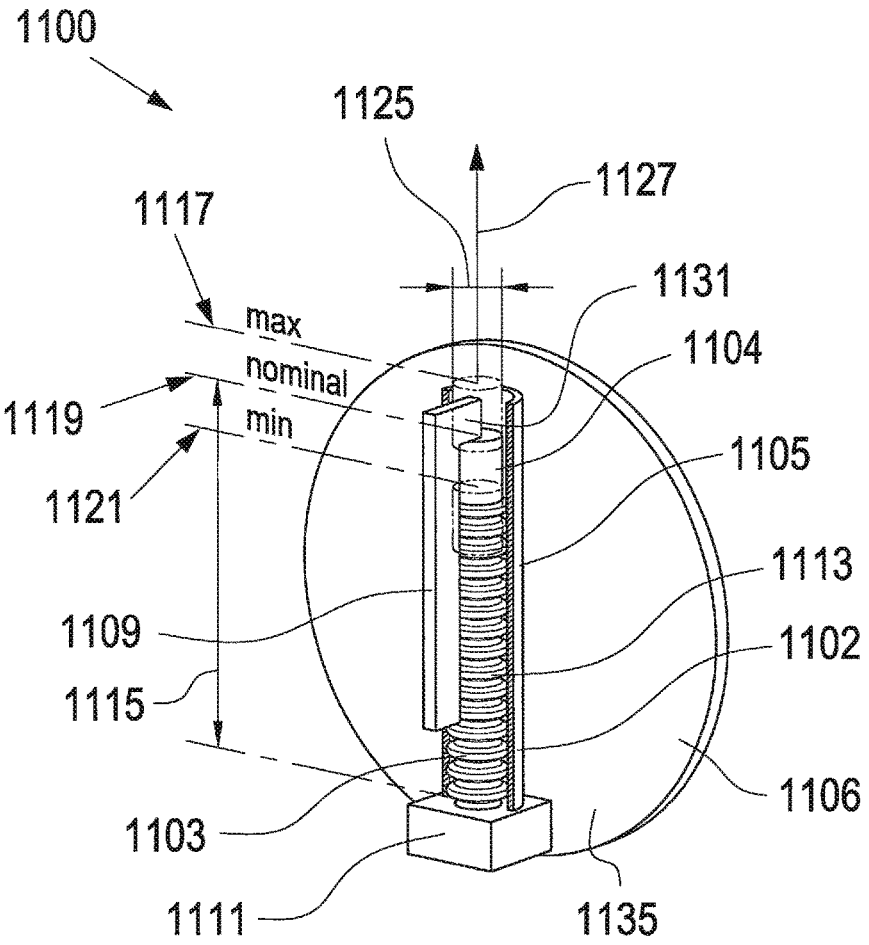
FIG. 11 is a schematic of the T-rod subsystem.
Figure 12G:
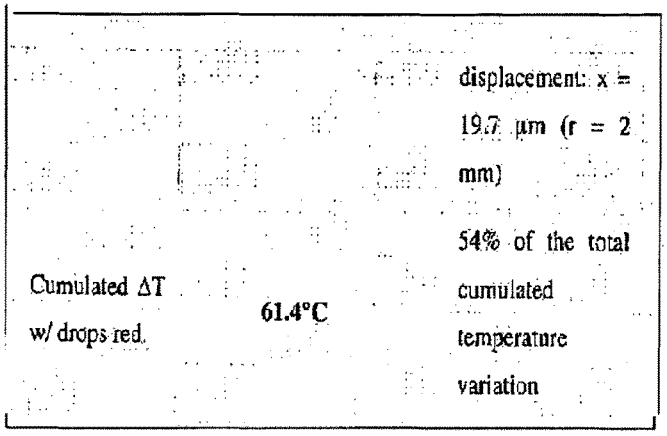
FIG. 12A is a schematic view of an alternate bellows of the invention.
FIG. 12B is a chart of temperature vs. time and its affect on the invention.
FIG. 12C is a table of temperature variation vs. displacement.
FIGS. 12D to 12Q are tables and graphs of other characteristic of the invention.
Figure 12H:
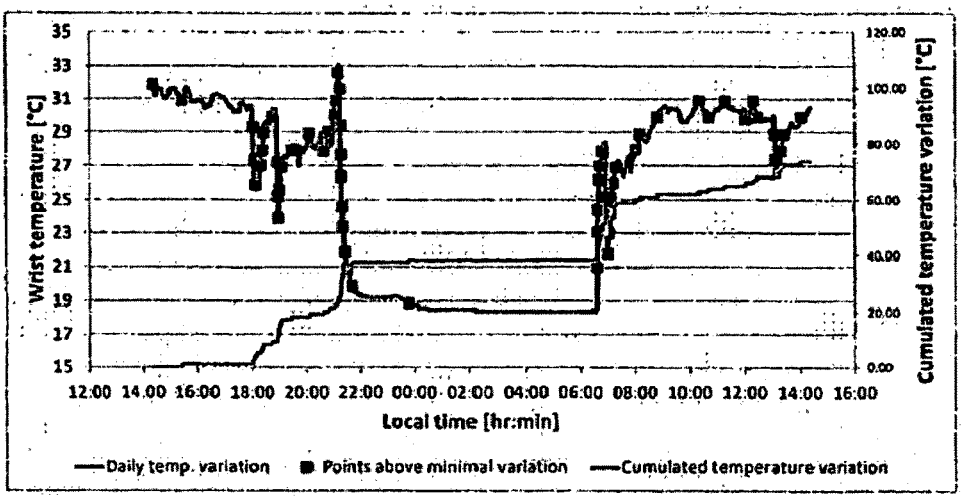
Figure 12I:
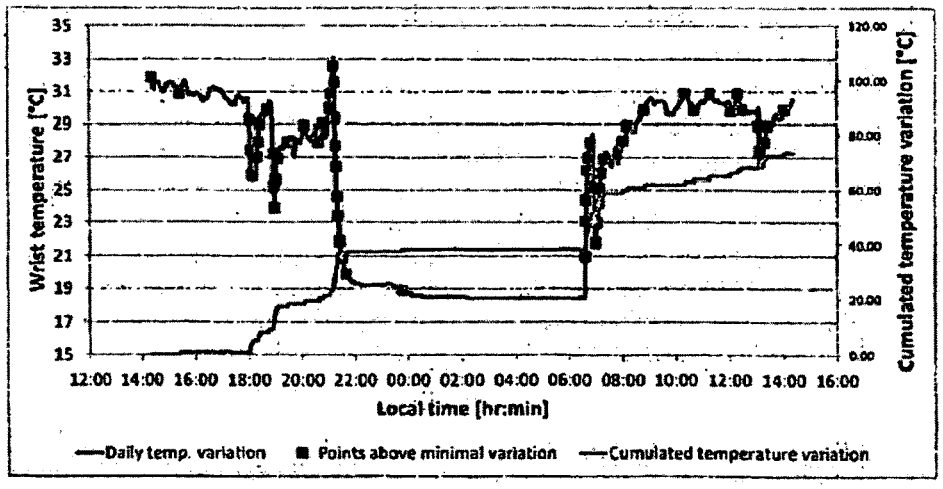
Figure 12Q:
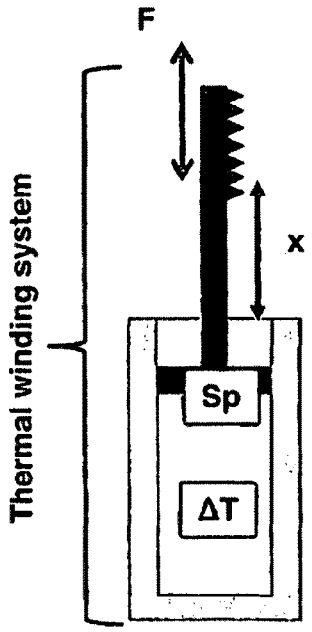
Figure 13A:
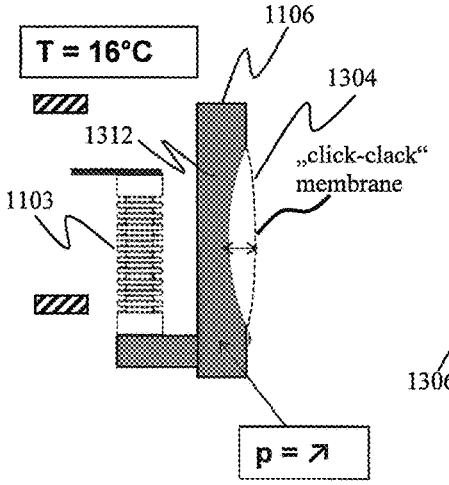
FIGS. 13A to 13D are schematics and charts describing a reset membrane having two nominal fluid capacities, depending on temperature.
Figure 13B:
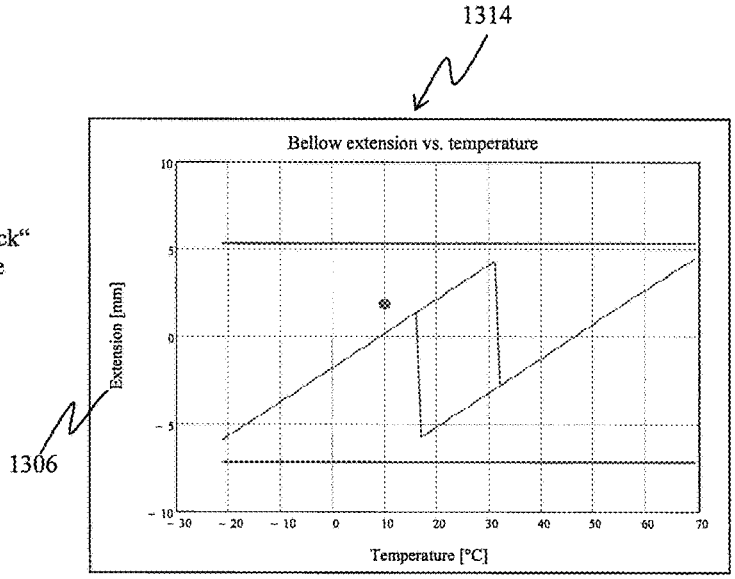
Figure 13A:
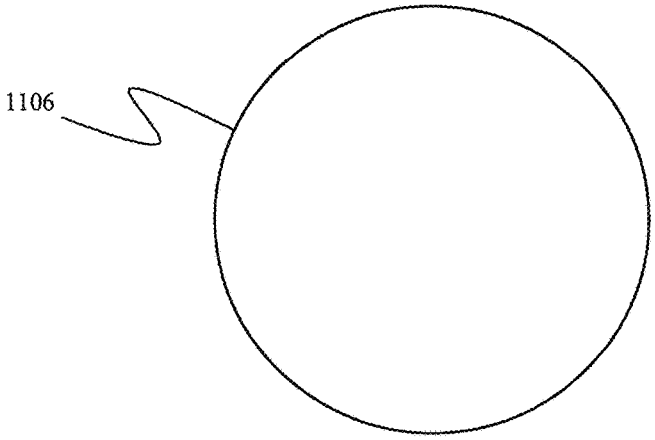

Now referring to FIG. 11, a rod sub-system 1100 is provided. Sub-system 1100 enables a method of energizing rod 1109 (similar to rod 1002) and the diagram 1314 of FIG. 13B illustrates the axial backwards and forwards movement as indicated by arrow 1115 of rectangular rod 1109 from a maximal position 1117 through a nominal position 1119 to a minimal position 1121 using a sub-system 1100 of the present invention, and displacements in between. The minimal position 1121 is obtained when the temperature is between 17 C and −20 C. The nominal position 1119 is obtained when the temperature is at 0.1 C with a delta T of 0.02 C. The maximal position 1117 is obtained at a temperature range from 32 C to 70 C. The displacement between the maximal position 1117 and the minimal position 1121 is approximately 9 mm, but of course displacements within any desired range are possible. The system includes a base 1111, fluid temperature expansion and contraction system 1102, top portion 1104, to which rod 1109 is connected, as well as circular heat transfer conduit 1106 to which base 1111 is connected. Fluid temperature expansion and contraction system 1102 is further comprised of a bellows 1103 which is filled with a thermally expanding and contracting fluid or gas 1113 in the interior thereof. An optional tubular outer sleeve 1105 around the bellows 1103 is also provided which is matingly and moveably connected to top portion 1104 allowing for movement of the top portion 1104 in relation to the sleeve 1105.

It is appreciated that base 1111 and heat transfer conduit 1106 are constructed from appropriate heat transferring materials such as metals and other thermally conductive materials to obtain the desired movement of rod 1102. A thickness of conduit 1106 is 1.3 mm in one variant of the invention with the length from the base 1100 to the nominal position of the middle of top portion 1104 being approximately 32.6 mm. The conduit 1106 itself has a diameter of 40 mm, but of course can be circular (cf. 1106 on FIG. 13A') or any other desired three dimensional geometry and dimensions can be used. An exemplary diameter of 4.9 mm of system 1100 is provided as indicated by arrow 1125, but other diameters and geometric cross sections can also be used. Various axial forces as illustrated by arrow 1127 are exerted by the system 1100 as desired depending choice of materials and the like. In one variant, a force of 30 N is generated by the system, but the system can be designed to exert forces in any desired watchmaker range. Of course, other dimensions and volumes of element 1102 are selected depending on the desired displacement of rod 1109. Rod 1109 is constructed to have a rectangular cross section in one variant of the invention, but in other variants of the invention the cross section can have a variety of cross sections, circular, oval, triangular, square, etc. Further rod 1109 has a connecting portion 1131 which off-sets and separates the mainbody of rod 1109 from the sleeve 1105 and allows motion of this sub-assembly in relation to the sleeve 1105 and conduit 1106. A thermally compressible/expandable fluid is located within bellows 1103. In one variant, a 30 N force is generated. Of course the materials from which sub-system is constructed can be varied such that the forces generated by the system are in a desired watchmaker range.

As such, the invention provides a mechanical sub-systems 900, 1000 for driving a function of a time piece. The sub-system includes a plurality of gear sub-assemblies (FIGS. 9A-10E). The gear sub-assemblies are positioned symmetrically on opposite sides of an a axis of a rod. The gear sub-assemblies being rotationally engaged with the rod while the rod moves bi-directionally and cyclically in relation to the gear sub-assemblies to obtain rod movement. The rod movement is driven by a means for thermal expansion and contraction as a result of a temperature differential. The rod movement is in the range of about 1-20 mm in one variant of the invention. It is further appreciated that the rod movement and displacement can be greater than this amount in another variant of the invention.

The invention further provides for a fluid-mechanical sub-system for driving a function of a user worn time piece (FIG. 11) The fluid mechanical sub-system 1100 include a rod 1109, and a fluid containing, bellows operated main body. The rod 1109 is constructed to be off-set from the main body, and the main body is thermally connected to a base 1111. The base 1111 is thermally connected to a heat transferring member 1106. The rod is capable of axial forward and backward movement as indicated by arrow 1105 within a range of positions based upon changes in temperature from a minimal position 1121, through a nominal position 1119 to a maximal position 1117 such that the rod 1109 only moves within an area 1135 defined by a surface 1137 of the heat transferring member 1106. It is appreciated that fluid-mechanical sub-system 1100 further can include one or more second sub-systems 900, 1000 (FIGS. 9A-10E). The second sub-systems 900, 1000 are constructed to use the forward and backward limited, axial movement of the rod 1109 to actuate the second sub-system(s).

It should be appreciated that the particular implementations shown and herein described are representative of the invention and its best mode and are not intended to limit the scope of the present invention in any way. As will be appreciated by skilled artisans, the present invention may be embodied as a system, a device, or a method.

The specification and figures should be considered in an illustrative manner, rather than a restrictive one and all modifications described herein are intended to be included within the scope of the invention claimed. Accordingly, the scope of the invention should be determined by the appended claims (as they currently exist or as later amended or added, and their legal equivalents) rather than by merely the examples described above. Steps recited in any method or process claims, unless otherwise expressly stated, may be executed in any order and are not limited to the specific order presented in any claim. Further, the elements and/or components recited in apparatus claims may be assembled or otherwise functionally configured in a variety of permutations to produce substantially the same result as the present invention. Consequently, the invention should not be interpreted as being limited to the specific configuration recited in the claims. Benefits, other advantages and solutions mentioned herein are not to be construed as critical, required or essential features or components of any or all the claims.

As is appreciated, a mechanical watch can be powered by the liquid expansion generated through an ambient temperature variation (thermal winding system, hereafter TWS). During the day, the watch is worn on the wrist (temperature variation from 18 to 33.degree. C. during 16 hours. During the night the watch is not worn (temperature drop from 31 to 25.degree. C. during 8 hours). During the day: $\Delta T_d$=15° C.*$Nb_d$ and during the night: $\Delta T_n$=6° C. The total temperature variation is $\Delta T=\Delta T_d+\Delta T_n$=15° C.*$Nb_d$+6° with $Nb_d$ to be defined at watchmaker's desired specification. The functional requirements of the time piece are: Daily stored energy: $E_s\approx$200 mJ (with the reference being: H1 and H2 barrels), as per the watch maker's specification. The max. liquid volume is $V_r\approx$2000 $mm^3$ or as desired by the watchmaker. The transmission requirements are minimal rotation: $\alpha_{i_min}$ 4°. The maximal force: $F_{i_max}\approx$15 N in one variant of the invention. The temperature requirements are as follows in one variant of the invention: working temperature range: $\Delta T_w$=15° C. (from 18° C. to 33° C.) and the safe temperature range is: $\Delta T_s$=90° C. (from −20° C. to 70° C.). The reference liquid is known by the trade name FC-40 and is used in the present invention. It has a density of $\rho_l$=1855 kg/m3, a specific heat of $C_l$=1100 J/(kg*° C.), and a coefficient of expansion of $\alpha_l$=0.0012 1/° C. Other fluids can also be used with similar properties. The dimensions of the TWS active surface are $S_p$=12.6 mm2 (r=2 mm), and include a required displacement from 18° C. to 33° C.:$x_{\Delta TW}\approx$3 mm, a required displacement from −20° C. to 70° C. of $x_{\Delta TS}\approx$18 mm, and a required force of F=f(ΔT). Based on this calculation two observations are made:

1. The daily cumulated ΔT is evaluated to define the force required on the system. A value close to 50° C. is used to limit the force applied on the mechanism.

2. The required safe displacement is large and not achievable by a standard metallic bellow, so other bellows materials are used, and a system 1304 to avoid over-extension 1306 is implemented.

A reservoir 1312 insulated from the body temperature is more sensitive to an environmental temperature drop and provides a better temperature drop conversion (80% instead of 50%).

Figure 13C:
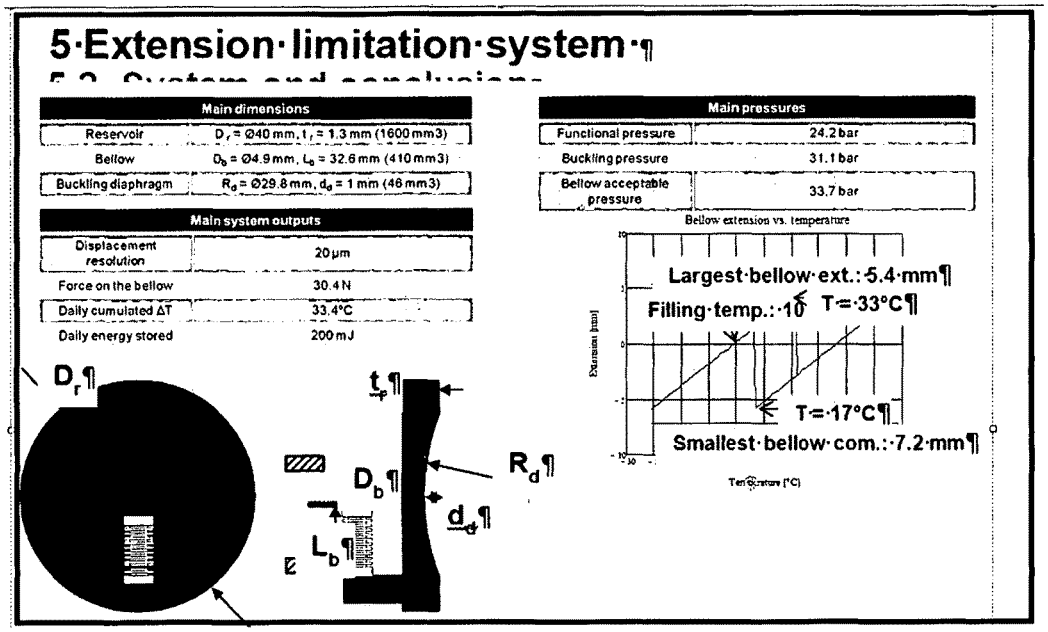
Figure 13D:
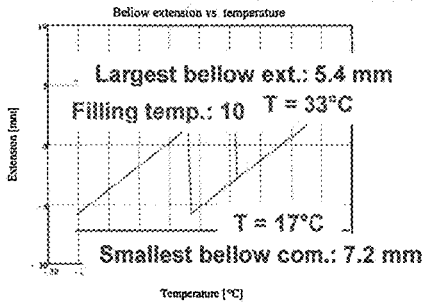
Figure 13D:
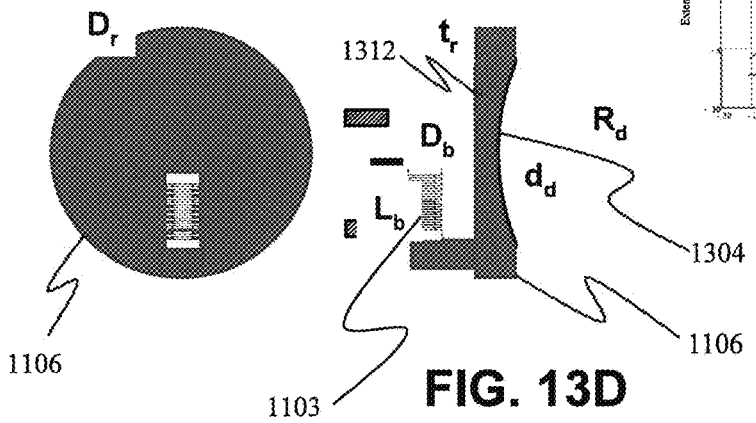

We have observed that required safe displacement is large and not achievable by a standard metallic bellow, and thus other materials for the bellows 1103 are used such as polymeric materials. A system 1304 (referred to as "click-clack" membrane in FIG. 13A) to avoid over-extension 1306 is also implemented, as evident by curve from FIG. 13B. The required minimal displacement of 20 μm is sufficient to generate the rotation of the inverter and the barrel preload. Of course, other displacements are also used herein according to the calculations, and material requirements conforming at least in part (see FIGS. 13A to 130). The disk 1106 is placed at the right side of the element above (FIG. 13A) in one variant of the invention. FIGS. 13A to 13C illustrate one version of the invention which is particularly effective for accomplishing the objectives of the invention.

The daily cumulated Delta T has a major impact on the effectiveness of the present invention. A cumulated ΔT of 50° C. is required to ensure suitable force inside the mechanism (F=20.3 N). An amount between 113.4° C. and 33.4° C. (including temperature drops and system thermal inertia compensation) is used based on measurement(s) performed with a data logger.

In one variant of the invention, an interface with the inverter/barrel is used. The conversion of the small system translation is required (~20 μm) to produce a rotation of 4° is achievable through an epicyclical gearing and/or a spur gears system having an overall dimension compatible with their integration into a wristwatch. The play in such systems is large and has to be removed in order to ensure that the translation of 20 μm is converted into a rotation of at least 4°. The design of a low play transmission system is established and tested through a representative demonstrator.

Extension limitation is also used herein. The extension limitation is based on the buckling of a small diaphragm to secure the bellow extension from −20° C. to 70° C. is also used herein. In particular, the required pressure to start the diaphragm buckling is verified, and the diaphragm materials are chosen to operate under the desired parameters to secure proper bellows extension. The verification of the thermal winding concept functionality is integrated within a wristwatch using a representative demonstrator under the following methodology:

In another variant of the invention, it is appreciated that the fluid-mechanical sub-system also includes a membrane with the system and components thereof. The membrane is capable of moving system components within a desired operating range. The membrane is selected and adapted to function at a temperature range outside of a user, and enables the system to operate.

As used herein, the terms "comprises", "comprising", or variations thereof, are intended to refer to a non-exclusive listing of elements, such that any apparatus, process, method, article, or composition of the invention that comprises a list of elements, that does not include only those elements recited, but may also include other elements described in the instant specification. Unless otherwise explicitly stated, the use of the term "consisting" or "consisting of" or "consisting essentially of" is not intended to limit the scope of the invention to the enumerated elements named thereafter, unless otherwise indicated. Other combinations and/or modifications of the above-described elements, materials or structures used in the practice of the present invention may be varied or adapted by the skilled artisan to other designs without departing from the general principles of the invention. The patents and articles mentioned above are hereby incorporated by reference herein, unless otherwise noted, to the extent that the same are not inconsistent with this disclosure.

Other characteristics and modes of execution of the invention are described in the appended claims. Further, the invention should be considered as comprising all possible combinations of every feature described in the instant specification, appended claims, and/or drawing figures which may be considered new, inventive and industrially applicable.

Copyright may be owned by the Applicant(s) or their assignee and, with, respect to express Licensees to third parties of the rights defined in one or more claims herein, no implied license is granted herein to use the invention as defined in the remaining claims. Further, vis-a-vis the public or third parties, no express or implied license is granted to prepare derivative works based on this patent specification, inclusive of the appendix hereto.

Additional features and functionality of the invention are described in the claims appended hereto. Such claims are hereby incorporated in their entirety by reference thereto in this specification and should be considered as part of the application as filed.

Multiple variations and modifications are possible in the embodiments of the invention described here. Although certain illustrative embodiments of the invention have been shown and described here, a wide range of changes, modifications, and substitutions is contemplated in the foregoing disclosure. While the above description contains many specific details, these should not be construed as limitations on the scope of the invention, but rather exemplify one or another preferred embodiment thereof. In some instances, some features of the present invention may be employed without a corresponding use of the other features. Accordingly, it is appropriate that the foregoing description be construed broadly and understood as being illustrative only, the spirit and scope of the invention being limited only by the claims which ultimately issue in this application.

What is claimed is:

1. A self-winding timepiece comprising: a casing, a movement, a main spring for driving the movement and a winding mechanism for the main spring in the casing, and an energy source for driving the winding mechanism which comprises a substantially C-shaped, closed reservoir, a fluid within the reservoir expanding or contracting as a function of a temperature differential, and a bellows disposed within the C-shape of the C-shaped reservoir, the bellows being in fluid connection with the reservoir and providing axially motion in response to the expansion or contraction of the fluid, further comprising: a plurality of bellows, at least two of the bellows being arranged with respect to one another at an angle of greater than 1 degree to less than about 180 degrees.

2. The self-winding timepiece of claim 1, further comprising a mechanical sub-system for driving a function of a time piece, the sub-system comprising: a plurality of gear sub-assemblies, the gear sub-assemblies being positioned on opposite sides of an a axis of a rod, and being rotationally engaged with the rod, the rod moving bi-directionally and cyclically in relation to the gear sub-assemblies to obtain rod movement, and the rod movement being driven by a means for thermal expansion and contraction as a result of a temperature differential.

3. The timepiece of claim 2 in which the rod is a rectangular rod.

4. The timepiece of claim 2 in which the rod movement is in the range of about 1-20 microns.

5. The self-winding timepiece of claim 1, further comprising a fluid-mechanical sub-system for driving a function of the time piece, the fluid-mechanical sub-system comprising: a rod, and a fluid containing, bellows operated main body, the rod being constructed to be off-set from the main body, the main body being connected to a base, the base being connected to a heat transferring member, the rod being capable of axial forward and backward movement within a range of positions based upon changes in temperature from a minimal position, through a nominal position to a maximal position such that the rod only moves within an area of the heat transferring member.

6. The self-winding timepiece of claim 5, wherein the fluid-mechanical sub-system further comprising a second sub-system, the second sub-system constructed to use the forward and backward axial movement of the rod to actuate the second sub-system.

7. The self-winding timepiece of claim 5, wherein the fluid-mechanical sub-system further comprises a click-clack membrane, the membrane being capable of moving system components within a desired operating range, and the membrane being selected and adapted to function at a temperature range outside of a user.

8. A self-winding timepiece comprising: a casing, a movement, a main spring for driving the movement and a winding mechanism for the main spring in the casing, and an energy source for driving the winding mechanism which comprises a substantially C-shaped, closed reservoir, a fluid within the reservoir expanding or contracting as a function of a temperature differential, and a bellows disposed within the C-shape of the C-shaped reservoir, the bellows being in fluid connection with the reservoir and providing axially motion in response to the expansion or contraction of the fluid, further comprising a plurality of bellows, at least two of the bellows being arranged with respect to one another at an angle of greater than 45 degree to less than 90 degrees, and in which at least two of the bellows are sized differently one from another.

* * * * *